US009156537B1

(12) United States Patent
Nakayasu

(10) Patent No.: US 9,156,537 B1
(45) Date of Patent: Oct. 13, 2015

(54) WATERCRAFT PROPULSION SYSTEM AND PROPULSION MACHINE CONTROLLING METHOD

(71) Applicant: YAMAHA HATSUDOKI KABUSHIKI KAISHA, Iwata-shi, Shizuoka (JP)

(72) Inventor: Yoshikazu Nakayasu, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 0 days.

(21) Appl. No.: 14/460,446

(22) Filed: Aug. 15, 2014

(30) Foreign Application Priority Data

Apr. 28, 2014 (JP) ..... 2014-092376

(51) Int. Cl.

| | |
|---|---|
| ***B60L 3/00*** | (2006.01) |
| ***B63H 21/21*** | (2006.01) |
| ***B63H 21/22*** | (2006.01) |
| ***B63H 25/06*** | (2006.01) |

(52) U.S. Cl.
CPC ..... *B63H 21/213* (2013.01); *B63H 21/22* (2013.01); *B63H 25/06* (2013.01); *B63H 2021/216* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,532,877 | A * | 8/1985 | Nagata et al. | 114/144 E |
| 6,234,853 | B1 * | 5/2001 | Lanyi et al. | 440/53 |
| 7,267,068 | B2 * | 9/2007 | Bradley et al. | 114/144 R |
| 7,305,928 | B2 * | 12/2007 | Bradley et al. | 114/144 R |
| 2004/0106337 | A1 * | 6/2004 | Okabe | 440/61 S |
| 2010/0145558 | A1 | 6/2010 | Kaji | |

FOREIGN PATENT DOCUMENTS

JP 2010-132127 A 6/2010

* cited by examiner

*Primary Examiner* — Thomas Tarcza
*Assistant Examiner* — Edward Pipala
(74) *Attorney, Agent, or Firm* — Keating & Bennett, LLP

(57) ABSTRACT

A watercraft propulsion system includes a normal watercraft operating unit, a joy stick watercraft operating unit, a control unit, a control mode switching unit, and a detection unit. The normal watercraft operating unit includes throttle levers and a steering wheel. The throttle levers are used to adjust outputs of at least two propulsion machines mounted to a hull. The steering wheel is used to adjust rudder turning angles of the at least two propulsion machines. The joy stick watercraft operating unit includes a joy stick. The joy stick is used to move the hull in at least each of front, rear, left, and right directions. The control unit is configured and programmed to control the outputs and the rudder turning angles of the at least two propulsion machines in a normal mode in accordance with an operation of the normal watercraft operating unit or a joy stick mode in accordance with an operation of the joy stick watercraft operating unit. The control mode switching unit is configured to output a control mode switching instruction to the control unit when the control mode switching unit has received a switching operation of the control mode.

16 Claims, 4 Drawing Sheets

WATERCRAFT PROPULSION SYSTEM AND PROPULSION MACHINE CONTROLLING METHOD

BACKGROUND OF THE INVENTION

1. Field of the Invention

The present invention relates to a watercraft propulsion system and a propulsion machine controlling method.

2. Description of the Related Art

In the conventional art, a watercraft includes a plurality of propulsion machines, a normal watercraft operating unit, and a joy stick watercraft operating unit. The normal watercraft operating unit includes throttle levers, which adjust the outputs of the plurality of propulsion machines; and a steering wheel, which adjusts the rudder turning angle of the plurality of propulsion machines. The joy stick watercraft operating unit includes a joy stick, which causes the hull to move in at least each of the front, rear, left, and right directions. A watercraft operator can operate the watercraft in any of the following control modes: a normal mode, which corresponds to the operation of the normal watercraft operating unit, and a joy stick mode, which corresponds to the operation of the joy stick watercraft operating unit.

Japanese Laid-Open Patent Application No. 2010-132127 discloses a technique that limits the transition from the normal mode to the joy stick mode in the case where the velocity of the hull (hereinbelow, referred to as the watercraft velocity) is a prescribed velocity or greater. According to this technique, it is possible to reduce a large load, which is produced by the water current, that is applied to the propulsion machines, which turn with the transition to the joy stick mode.

Nevertheless, in the technique disclosed in Japanese Laid-Open Patent Application No. 2010-132127, it is necessary to provide the hull with a watercraft velocity detecting device (e.g., a velocity sensor, a GPS receiver, and the like); consequently, if the watercraft velocity detecting device is not provided, then the technique cannot be used, which causes a problem.

SUMMARY OF THE INVENTION

Preferred embodiments of the present invention have been conceived in view of the problems discussed above, and provide a watercraft propulsion system configured to reduce the load applied to a plurality of propulsion machines without the use of a watercraft velocity detecting device.

According to a preferred embodiment of the present invention, a watercraft propulsion system includes a normal watercraft operating unit, a joy stick watercraft operating unit, a control unit, a control mode switching unit, and a detection unit. The normal watercraft operating unit includes throttle levers and a steering wheel. The throttle levers are used to adjust outputs of at least two propulsion machines mounted to a hull. The steering wheel is used to adjust rudder turning angles of the at least two propulsion machines. The joy stick watercraft operating unit includes a joy stick. The joy stick is used to move the hull in at least each of front, rear, left, and right directions. The control unit is configured and programmed to control the outputs and the rudder turning angles of the at least two propulsion machines in a normal mode in accordance with an operation of the normal watercraft operating unit or a joy stick mode in accordance with an operation of the joy stick watercraft operating unit. The control mode switching unit is configured to output a control mode switching instruction to the control unit when the control mode switching unit has received a switching operation of the control mode. The detection unit is configured to detect the rotational speed of the engines of the at least two propulsion machines. When throttle valves of the engines have moved from an open position to a fully closed position in the case where the control mode is the normal mode, the control unit does not receive the control mode switching instruction output from the control mode switching unit until a control mode switching prohibition period elapses. The control mode switching prohibition period is set based on the rotational speed detected by the detection unit.

Preferred embodiments of the present invention provide a watercraft propulsion system that is configured to reduce the load applied to a plurality of propulsion machines without using a watercraft velocity detecting device.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
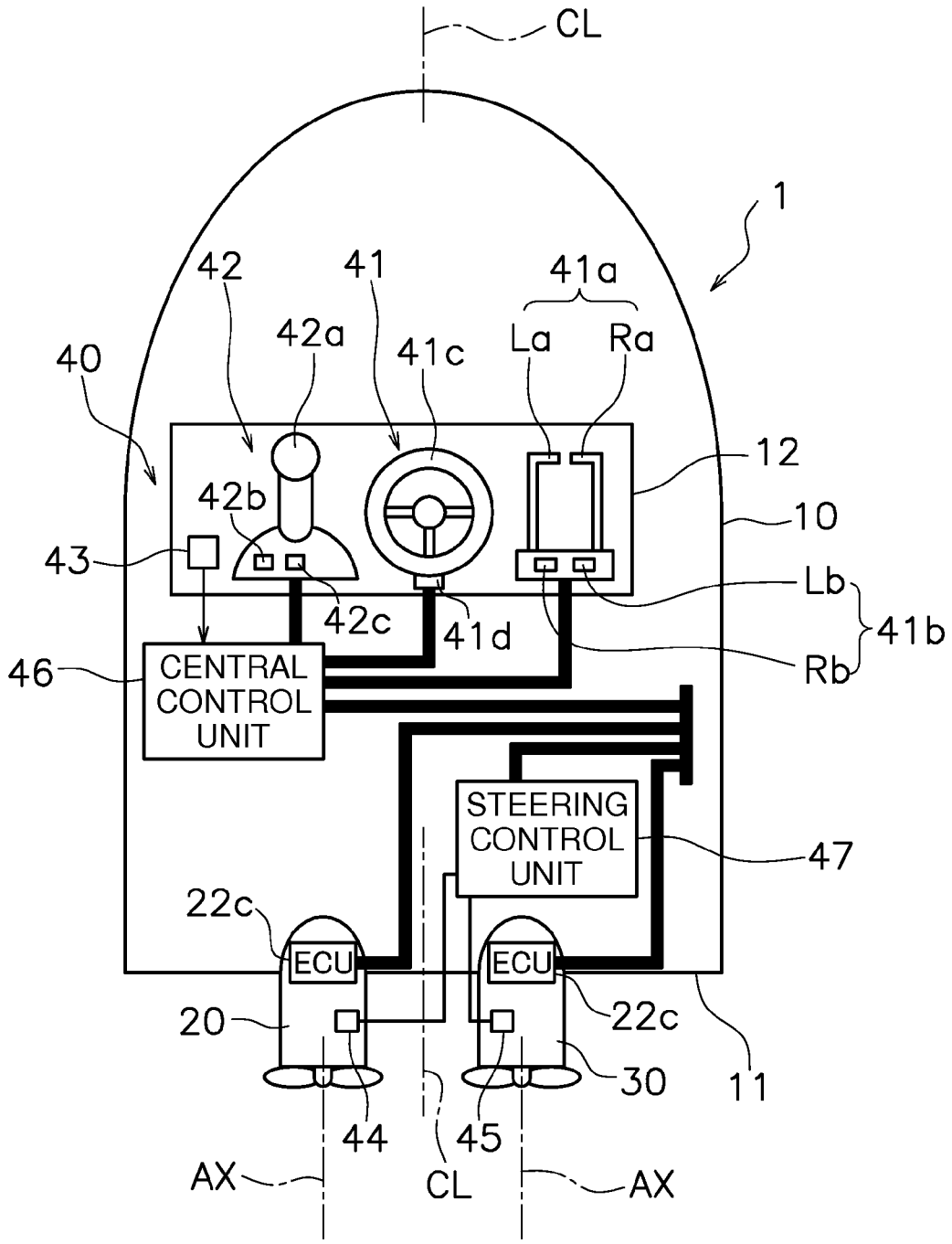
FIG. 1 is a schematic drawing of a watercraft on which a watercraft propulsion system is installed.
Figure 2:
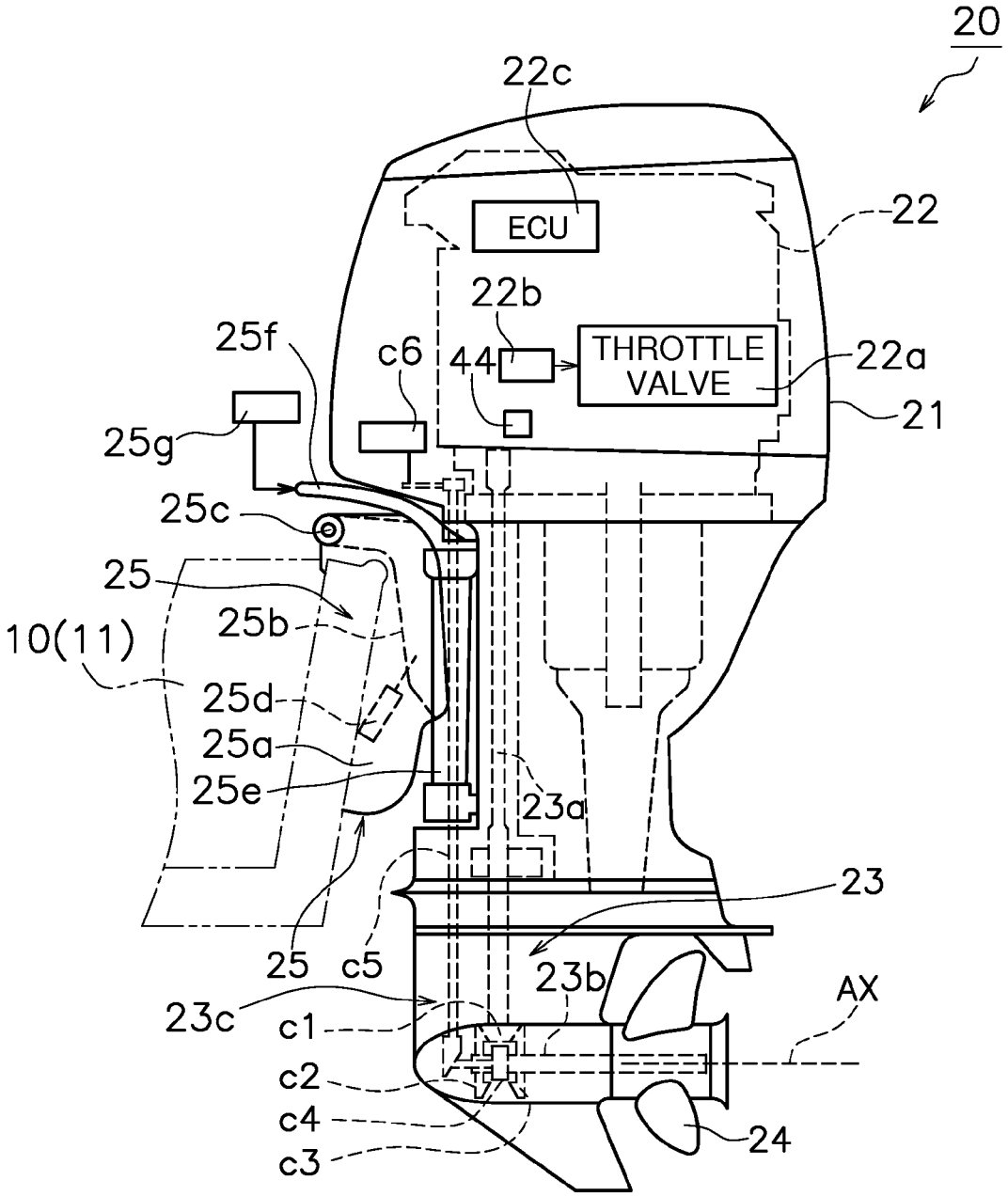
FIG. 2 is a side view of a propulsion machine.

Preferred embodiments of the present invention will now be explained with reference to the drawings. FIG. 1 is a schematic drawing that shows a watercraft 1. FIG. 2 is a side view that shows a first propulsion machine 20.

The watercraft 1 is preferably a craft such as a cruiser or a boat, for example. As shown in FIG. 1, the watercraft 1 includes a hull 10, the first propulsion machine 20, a second propulsion machine 30, and a watercraft propulsion system 40.

The hull 10 includes a transom 11 and an operation platform 12. The first propulsion machine 20 and the second propulsion machine 30 are mounted to the transom 11. The first propulsion machine 20 is disposed leftward of a centerline CL of the hull 10. The second propulsion machine 30 is disposed rightward of the centerline CL. In the present preferred embodiment, the first propulsion machine 20 and the second propulsion machine 30 are disposed such that they have left-right symmetry with respect to the centerline CL. The centerline CL indicates the center of the hull 10 in the left and right directions and extends in the forward and reverse directions of the hull 10.

As shown in FIG. 2, the first propulsion machine 20 includes a cover member 21, an engine 22, a driving force transmitting mechanism 23, a propeller 24, and a mounting mechanism 25. The cover member 21 houses the engine 22 and the driving force transmitting mechanism 23. The engine 22 generates the driving force to propel the watercraft 1. A throttle valve 22*a*, a throttle actuator 22*b*, and a propulsion machine ECU 22*c* are mounted to the engine 22. The throttle valve 22*a* changes the amount of air that is sucked into the engine 22. The throttle actuator 22*b* drives the throttle valve 22*a*. The propulsion machine ECU 22*c* controls the throttle actuator 22*b* and a shift actuator c6, which is described below.

The driving force transmitting mechanism 23 transmits the driving force of the engine 22 to the propeller 24. The driving force transmitting mechanism 23 includes a drive shaft 23*a*, a propeller shaft 23*b*, and a shift mechanism 23*c*. The drive shaft 23*a* extends in the up and down directions. The propeller shaft 23*b* extends in the horizontal direction. The shift mechanism 23*c* switches the transmission of the driving force from the drive shaft 23*a* to the propeller shaft 23*b*. The shift mechanism 23*c* includes a pinion gear c1, a forward gear c2, a reverse gear c3, a dog clutch c4, a shift rod c5, and the shift actuator c6. The pinion gear c1 is coupled to a lower end portion of the drive shaft 23*a*. The pinion gear c1 meshes with the forward gear c2 and the reverse gear c3. The forward gear c2 and the reverse gear c3 rotate in directions opposite to one another. The dog clutch c4 is coupled to the propeller shaft 23*b* via a spline and rotates together with the propeller shaft 23*b*. The dog clutch c4 moves along an axial center AX of the propeller shaft 23*b* in accordance with the turning of the shift rod c5 by the shift actuator c6. The dog clutch c4 is configured to move to any the following shift positions: a forward propulsion position, a reverse propulsion position, and a neutral position. If the dog clutch c4 is at the forward propulsion position, then the rotation of the drive shaft 23*a* is transmitted to the propeller shaft 23*b* via the dog clutch c4 and the forward gear c2. If the dog clutch c4 is at the reverse propulsion position, then the rotation of the drive shaft 23*a* is transmitted to the propeller shaft 23*b* via the dog clutch c4 and the reverse gear c3. If the dog clutch c4 is at the neutral position, then the rotation of the drive shaft 23*a* is not transmitted to the propeller shaft 23*b*. The propeller 24 is mounted to a rear end portion of the propeller shaft 23*b* and rotates together with the propeller shaft 23*b*. The rotation of the propeller 24 generates a propulsive force around the axial center AX of the propeller shaft 23*b*. If the dog clutch c4 is at the forward propulsion position, then a propulsive force is generated that propels the hull 10 forward; furthermore, if the dog clutch c4 is at the reverse propulsion position, then a propulsive force is generated that propels the hull 10 rearward.

The mounting mechanism 25 includes a clamp bracket 25*a*, a swivel bracket 25*b*, a tilt axis 25*c*, a trim actuator 25*d*, a rudder turning axis 25*e*, a rudder turning rod 25*f*, and a rudder turning actuator 25*g*. The clamp bracket 25*a* is attachably and detachably mounted to the transom 11 of the hull 10. The swivel bracket 25*b* is coupled to the clamp bracket 25*a* such that it is configured to pivot about the tilt axis 25*c*. The trim actuator 25*d* changes a trim angle of the first propulsion machine 20 by causing the swivel bracket 25*b* to pivot. The cover member 21 is coupled to the swivel bracket 25*b* such that it is configured to pivot about the rudder turning axis 25*e*. The rudder turning rod 25*f* is fixed to the cover member 21. The rudder turning actuator 25*g* changes a rudder turning angle of the first propulsion machine 20 by driving the rudder turning rod 25*f*. The rudder turning angle is the angle defined by the axial center AX of the propeller shaft 23*b* with respect to the centerline CL of the hull 10.

The second propulsion machine 30 preferably has the same configuration as the first propulsion machine 20 described above.

As shown in FIG. 1 and FIG. 2, the watercraft propulsion system 40 includes a normal watercraft operating unit 41, a joy stick watercraft operating unit 42, a control mode switching unit 43, a first detection unit 44, a second detection unit 45, a central control unit 46 (i.e., one example of a control unit), and a steering control unit 47. The normal watercraft operating unit 41, the joystick watercraft operating unit 42, and the control mode switching unit 43 are preferably disposed on the operation platform 12 of the hull 10.

The normal watercraft operating unit 41 includes a throttle lever 41*a*, a lever position sensor 41*b*, a steering wheel 41*c*, and a steering operation angle sensor 41*d*. The throttle lever 41*a* includes a first throttle lever La and a second throttle lever Ra. The first throttle lever La and the second throttle lever Ra are operating members configured to adjust the outputs of the first propulsion machine 20 and the second propulsion machine 30, respectively. The first throttle lever La and the second throttle lever Ra are each configured to move to a neutral range to stop the hull 10, a forward propulsion range to propel the hull 10 forward, and a reverse propulsion range to propel the hull 10 rearward. The forward propulsion range is provided frontward of the neutral range, and the reverse propulsion range is provided rearward of the neutral range. When the first throttle lever La is tilted from the neutral range to the forward propulsion range, the dog clutch c4 of the first propulsion machine 20 moves from the neutral position to the forward propulsion position. When the first throttle lever La is tilted from the neutral range to the reverse propulsion range, the dog clutch c4 of the first propulsion machine 20 moves from the neutral position to the reverse propulsion position. If the first throttle lever La is in the neutral range, then the throttle valve 22*a* is maintained at a fully closed position. If the first throttle lever La is in the forward propulsion range or the reverse propulsion range, then the throttle valve 22*a* moves to an open position. In this case, the larger the tilt angle of the first throttle lever La, the wider the opening degree of the throttle valve 22*a*, and the higher the rotational speed of the engine 22. The second throttle lever Ra preferably has the same configuration as the first throttle lever La.

The lever position sensor 41*b* senses the operation position of the throttle lever 41*a*. The lever position sensor 41*b* includes a first lever position sensor Lb and a second lever position sensor Rb. The first lever position sensor Lb senses the range in which the first throttle lever La is positioned and the tilt angle of the first throttle lever La and outputs first lever position information indicating the range and the tilt angle to the central control unit 46. The second lever position sensor Rb senses the range in which the second throttle lever Ra is positioned and the tilt angle of the second throttle lever Ra and outputs second lever position information indicating the range and the tilt angle to the central control unit 46.

The steering wheel 41*c* is an operating member configured to adjust the rudder turning angle of the first propulsion machine 20 and the rudder turning angle of the second propulsion machine 30. In each of the first and second propulsion machines 20, 30, the rudder turning rod 25*f* is driven by the rudder turning actuator 25*g* in accordance with the rotating operation of the steering wheel 41*c*. The steering operation angle sensor 41*d* senses an operation angle of the steering wheel 41*c* and outputs to the central control unit 46 operation angle information that indicates the operation angle.

The joy stick watercraft operating unit 42 includes a joy stick 42*a*, a stick position sensor 42*b*, and a stick twist sensor 42*c*. The joy stick 42*a* is an operating member configured to cause the hull 10 to move in at least each of the front, rear, left, and right directions. The joy stick 42*a* preferably has the shape of a rod, for example. The joy stick 42*a* is configured to tilt in at least each of the front, rear, left, and right directions and to twist about an axial center. The hull 10 moves parallel or substantially parallel to the tilt direction in accordance with the tilting operation of the joy stick 42*a* and steers in a twisting direction in accordance with the twisting operation of the joy stick 42*a*. The stick position sensor 42*b* senses the tilt direction and the tilt angle of the joy stick 42*a* and outputs to the central control unit 46 tilt position information indicating the tilt direction and the tilt angle. The stick twist sensor 42*c* senses the twist direction and the twist angle of the joy stick

42*a* and outputs to the central control unit 46 twist position information indicating the twist direction and the twist angle.

The control mode switching unit 43 is configured and programmed to receive from an operator an operation that switches, by the central control unit 46, the control mode of the first propulsion machine 20 and the second propulsion machine 30. By operating the control mode switching unit 43, the operator selects any control mode, namely, a "normal mode" in accordance with the operation of the normal watercraft operating unit 41 and a "joy stick mode" in accordance with the operation of the joy stick watercraft operating unit 42. When the control mode switching unit 43 receives a switching operation, a control mode switching instruction that indicates the selected control mode is output to the central control unit 46. The control mode switching unit 43 is, for example, a push button type switch.

As shown in FIG. 1 and FIG. 2, the first detection unit 44 is mounted to the first propulsion machine 20. The first detection unit 44 detects the rotational speed (hereinbelow, referred to as "first rotational speed N1") of the engine 22 of the first propulsion machine 20 by detecting the rotation of a crankshaft (not shown). The first detection unit 44 outputs the detected first rotational speed N1 to the central control unit 46 via the propulsion machine ECU 22*c* of the first propulsion machine 20.

As shown in FIG. 1, the second detection unit 45 is mounted to the second propulsion machine 30. The second detection unit 45 detects the rotational speed (hereinbelow, referred to as "second rotational speed N2") of the engine 22 of the second propulsion machine 30 by detecting the rotation of a crankshaft (not shown). The second detection unit 45 outputs the detected second rotational speed N2 to the central control unit 46 via the propulsion machine ECU 22*c* of the second propulsion machine 30.

The central control unit 46 is configured and programmed to control the first propulsion machine 20 and the second propulsion machine 30 in any control mode, namely, the normal mode and the joy stick mode.

If the control mode is the normal mode, the central control unit 46 is configured and programmed to control the outputs of the first propulsion machine 20 and the second propulsion machine 30 in accordance with the operation of the normal watercraft operating unit 41. Specifically, the central control unit 46 acquires, from the first lever position sensor Lb, the first lever position information, which indicates the range (i.e., the neutral range, the forward propulsion range, or the reverse propulsion range) in which the first throttle lever La is positioned and the tilt angle. The central control unit 46 is configured and programmed to control the shift actuator c6 via the propulsion machine ECU 22*c* such that the dog clutch c4 moves to the shift position (i.e., the neutral position, the forward propulsion position, or the reverse propulsion position) corresponding to the range in which the first throttle lever La is positioned. If the first throttle lever La is in the neutral range, the central control unit 46 maintains the throttle valve 22*a* at the fully closed position. If the first throttle lever La is in the forward propulsion range or the reverse propulsion range, the central control unit 46 causes the throttle valve 22*a* to move to the open position. At this time, the larger the tilt angle of the first throttle lever La, the more the central control unit 46 widens the opening degree of the throttle valve 22*a*. If the first throttle lever La returns from the forward propulsion range or the reverse propulsion range to the neutral range, the central control unit 46 causes the throttle valve 22*a* to move from the open position to the fully closed position.

Likewise, the central control unit 46 acquires, from the second lever position sensor Rb, the second lever position information, which indicates the range in which the second throttle lever Ra is positioned and the tilt angle, and controls the shift actuator c6 and the throttle actuator 22*b* of the second propulsion machine 30.

If the control mode is the normal mode, the central control unit 46 is configured and programmed to control the rudder turning angles of the first propulsion machine 20 and the second propulsion machine 30 in accordance with the operation of the lever position sensor 41*b*. Specifically, the central control unit 46 acquires the operation angle information from the steering operation angle sensor 41*d*. The central control unit 46 is configured and programmed to control the rudder turning actuators 25*g* of the first propulsion machine 20 and the second propulsion machine 30 via the steering control unit 47 such that the rudder turning angles of the first propulsion machine 20 and the second propulsion machine 30 correspond to the operation angle of the steering wheel 41*c*.

If the control mode is the joy stick mode, the central control unit 46 is configured and programmed to control the output and the rudder turning angle of each of the first and second propulsion machines 20, 30 in accordance with the operation of the joy stick watercraft operating unit 42. Specifically, the central control unit 46 is configured and programmed to control the rudder turning actuator 25*g* of each of the first and second propulsion machines 20, 30 via the steering control unit 47 such that each of the first and second propulsion machines 20, 30 turn in the toe-in direction. The toe-in direction is the direction in which the front end of each of the first and second propulsion machines 20, 30 is closer to the centerline CL of the hull 10 than the rear end is. The central control unit 46 acquires, from the stick position sensor 42*b*, the tilt position information that indicates the tilt direction and the tilt angle of the joy stick 42*a* and acquires, from the stick twist sensor 42*c*, the twist position information that indicates the twist direction and the twist angle of the joy stick 42*a*. The central control unit 46 is configured and programmed to control the shift actuator c6 and the throttle actuator 22*b* via the propulsion machine ECU 22*c* of each of the first and second propulsion machines 20, 30 such that, while the hull 10 moves parallel or substantially parallel to the tilt direction at a watercraft velocity in accordance with the tilt angle of the joy stick 42*a*, the hull 10 turns in the twist direction at an angular velocity in accordance with the twist angle of the joy stick 42*a*.

If the control mode is the joy stick mode, the central control unit 46 is configured and programmed to receive the control mode switching instruction output from the control mode switching unit 43. When the central control unit 46 receives the control mode switching instruction, the central control unit 46 switches the control mode from the joy stick mode to the normal mode.

If the control mode is the normal mode, then, when the first throttle lever La is in the forward propulsion range or the reverse propulsion range, namely, when the throttle valve 22*a* is positioned at the open position, the central control unit 46 does not receive the control mode switching instruction output from the control mode switching unit 43.

If the control mode is the normal mode, then, when the throttle valve 22*a* has moved from the open position to the fully closed position due to the movement of the first throttle lever La from the reverse propulsion range to the neutral range, the central control unit 46 receives the control mode switching instruction output from the control mode switching unit 43. When the central control unit 46 receives the control mode switching instruction, the central control unit 46 switches the control mode from the normal mode to the joy stick mode.

If the control mode is the normal mode, then, when the throttle valve 22*a* has moved from the open position to the fully closed position due to the movement of the first throttle lever La from the forward propulsion range to the neutral range, the central control unit 46 is configured and programmed to determine whether to receive the control mode switching instruction, as explained below. First, the central control unit 46 acquires, from the first detection unit 44, the first rotational speed N1 of the engine 22 of the first propulsion machine 20 and acquires, from the second detection unit 45, the second rotational speed N2 of the engine 22 of the second propulsion machine 30. Next, the central control unit 46 sets, of the first rotational speed N1 and the second rotational speed N2, the first rotational speed N1 as a "reference rotational speed Nr." Next, based on the reference rotational speed Nr, the central control unit 46 is configured and programmed to set a "mode switching prohibition period" in order to put switching from the normal mode to the joy stick mode on standby.

The central control unit 46 is preferably configured to set the mode switching prohibition period as, for example, explained next. First, as shown in Table 1, the central control unit 46 stores six candidate periods corresponding to six rotational speed ranges, and selects, from among the six rotational speed ranges, the rotational speed range that includes the reference rotational speed Nr. Next, the central control unit 46 sets the candidate period corresponding to the selected rotational speed range as the mode switching prohibition period. As shown in Table 1, the mode switching prohibition period is set such that the higher the reference rotational speed Nr, the longer the mode switching prohibition period.

TABLE 1

| Rotational Speed Range (rpm) | <1,000 | 1,000-2,000 | 2,000-3,000 | 3,000-4,000 | 4,000-5,000 | >5,000 |
|---|---|---|---|---|---|---|
| Candidate Period (s) | 0 | 1 | 2 | 4 | 8 | 12 |

Figure 3:
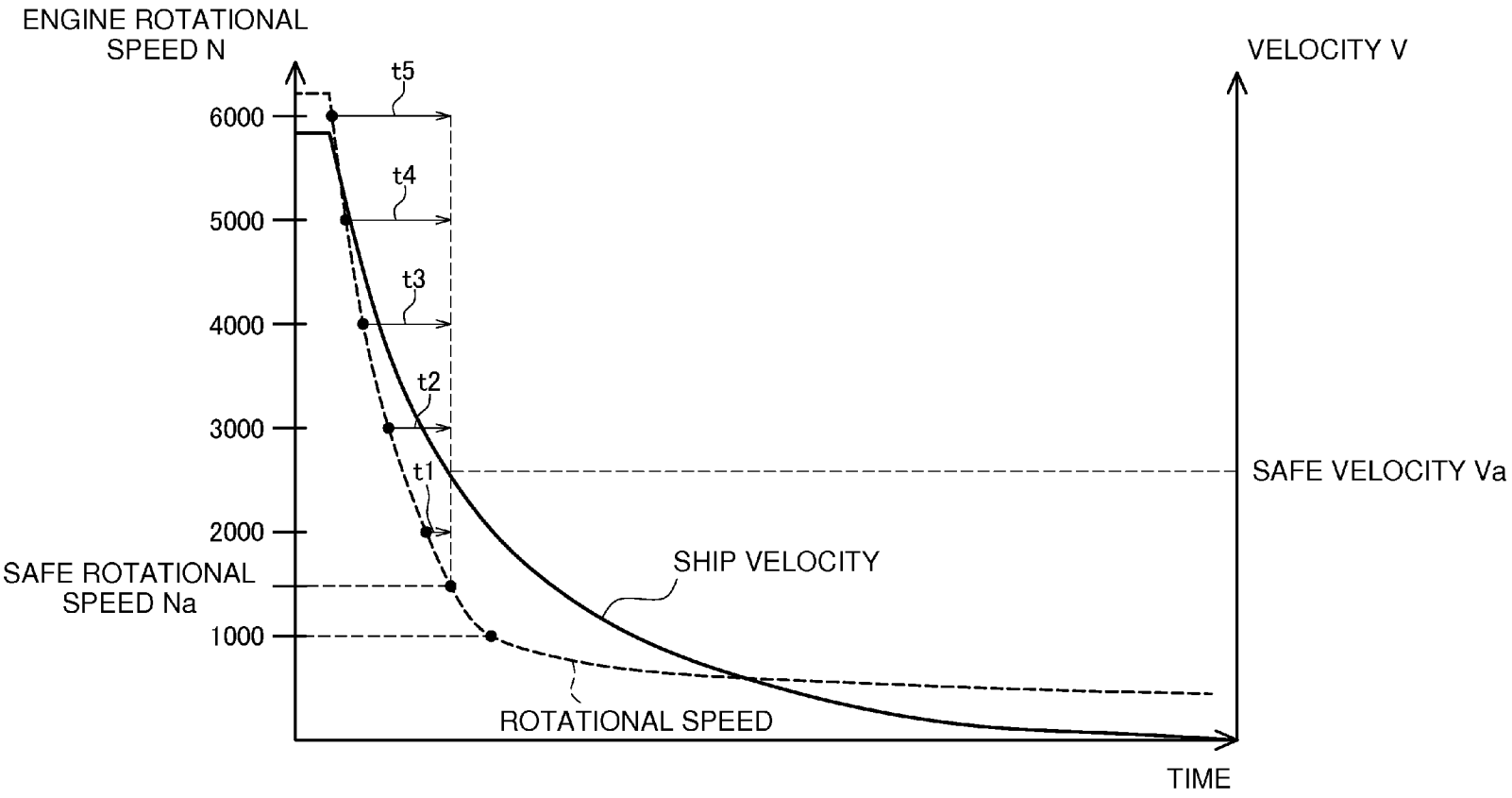
FIG. 3 is a graph that shows one example of a relationship between engine rotational speed and watercraft velocity.

FIG. 3 is a graph that shows one example of the relationship between an engine rotational speed N (i.e., the broken line) and a watercraft velocity V (i.e., the solid line). In FIG. 3, the arrows indicate examples of required times needed for the engine rotational speed N to fall to a "safe rotational speed Na" after the throttle valve 22*a* has moved from the open position to the fully closed position. The safe rotational speed Na is the rotational speed of the engine corresponding to a "safe velocity Va." The safe velocity Va is the velocity that is low enough for the load due to the water current to be safely applied to the first propulsion machine 20 and the second propulsion machine 30 even if the control mode switches from the normal mode to the joy stick mode and the first propulsion machine 20 and the second propulsion machine 30 turn in the toe-in direction. The candidate periods listed in Table 1 are set longer than the required times t1-t5 shown in FIG. 3. Namely, each of the candidate periods is set to a time that is calculated by adding a prescribed margin time to the actual required time. Furthermore, as shown in FIG. 3, because the safe velocity Va is higher than 1,000 rpm, the candidate period corresponding to the rotational speed range that is less than 1,000 rpm is set to 0 s, for example, as shown in Table 1. If the mode switching prohibition period is 0 s, then the mode switching prohibition period is not set, and consequently the switching from the normal mode to the joy stick mode is performed immediately.

Once the central control unit 46 has set the mode switching prohibition period, the central control unit 46 does not receive the control mode switching instruction during the period until the mode switching prohibition period has elapsed, even if the control mode switching instruction is output from the control mode switching unit 43. If the control mode switching instruction is output from the control mode switching unit 43 after the mode switching prohibition period has elapsed, the central control unit 46 receives the control mode switching instruction and switches the control mode from the normal mode to the joy stick mode. Accordingly, the control mode does not switch unless the operator operates the control mode switching unit 43 after the mode switching prohibition period.

Furthermore, during the mode switching prohibition period, the control mode is maintained in the normal mode, and consequently, if the normal watercraft operating unit 41 (including the throttle lever 41*a* and the steering wheel 41*c*) is operated by the operator during the mode switching prohibition period, the central control unit 46 is configured and programmed to control the first propulsion machine 20 and the second propulsion machine 30 in accordance with the operation of the normal watercraft operating unit 41. At this time, the central control unit 46 discards the previously set mode switching prohibition period.

Figure 4:
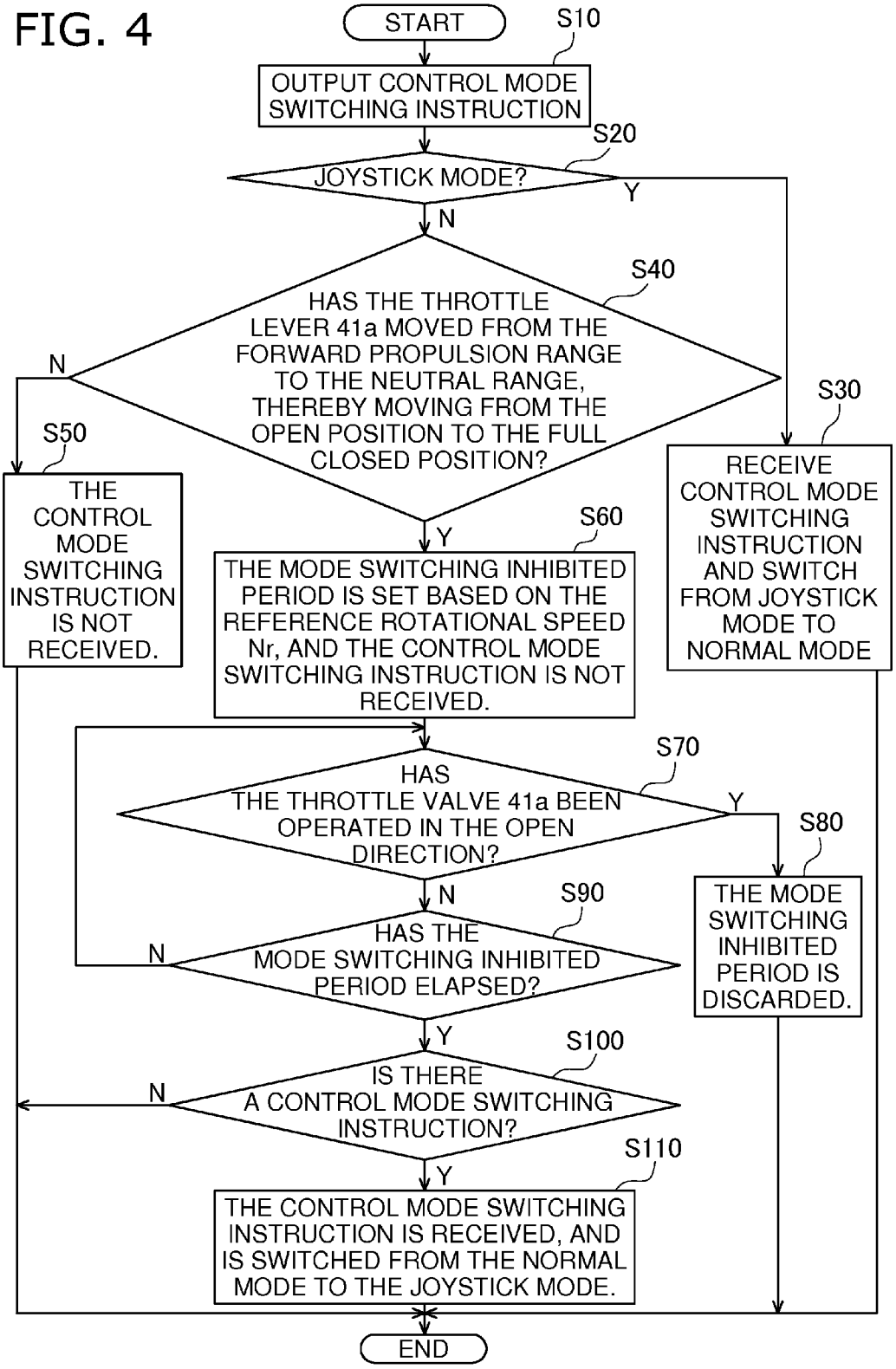
FIG. 4 is a flow chart for explaining the operation of the watercraft propulsion system.

The operation of the watercraft propulsion system 40 in the case wherein the operator has switched the control mode is explained next, with reference to the drawings. FIG. 4 is a flow chart for explaining the operation of the watercraft propulsion system 40.

In a step S10, the control mode switching unit 43 receives the control mode switching operation and outputs the control mode switching instruction to the central control unit 46.

In a step S20, the central control unit 46 determines whether the control mode is the joy stick mode. If the control mode is the joy stick mode, then, in a step S30, the central control unit 46 receives the control mode switching instruction and switches the control mode from the joy stick mode to the normal mode. If the control mode is the normal mode, then the process proceeds to a step S40.

In the step S40, the central control unit 46 determines whether the throttle valve 22*a* has moved from the open position to the fully closed position due to the movement of the first throttle lever La from the forward propulsion range to the neutral range. If the first throttle lever La is positioned in the forward propulsion range or the reverse propulsion range, or if the first throttle lever La has moved from the reverse propulsion range to the neutral range, then, in a step S50, the central control unit 46 terminates the process without receiving the control mode switching instruction. If the throttle valve 22*a* has moved from the open position to the fully closed position due to the movement of the first throttle lever La from the forward propulsion range to the neutral range, then the process proceeds to step S60.

In the step S60, the central control unit 46 sets, of the first rotational speed N1 and the second rotational speed N2, the first rotational speed N1 as the reference rotational speed Nr. Continuing, the central control unit 46 sets the mode switching prohibition period based on the reference rotational speed Nr and does not receive the control mode switching instruction. At this time, the central control unit 46 starts the clock to count down the mode switching prohibition period.

In a step S70, the central control unit 46 determines whether the operator has operated the throttle lever 41*a* in the opening direction. If the throttle lever 41*a* has not been operated, the central control unit 46, in a step S80, discards the mode switching prohibition period and then terminates the process. If the throttle lever 41*a* has been operated, the process proceeds to a step S90.

In a step S90, the central control unit 46 determines whether the mode switching prohibition period has elapsed. If the mode switching prohibition period has not elapsed, then the process returns to the step S70. If the mode switching prohibition period has elapsed, then the process proceeds to a step S100.

In the step S100, the central control unit 46 determines whether the control mode switching instruction has been re-output from the control mode switching unit 43. If the control mode switching instruction has been re-output, then, in a step S110, the central control unit 46 receives the control mode switching instruction and switches the control mode from the normal mode to the joy stick mode. If the control mode switching instruction has not been re-output, the central control unit 46 terminates the process.

As explained above, in the normal mode, when the throttle valve 22*a* has moved from the open position to the fully closed position due to the movement of the first throttle lever La from the forward propulsion range to the neutral range, the central control unit 46 according to the present preferred embodiment does not receive the control mode switching instruction until the mode switching prohibition period, which was set based on the reference rotational speed Nr, has elapsed. Accordingly, when the control mode is switching from the normal mode to the joy stick mode, the load applied to the first and second propulsion machines 20, 30 is reduced without using a watercraft velocity detecting device.

The above description refers to various preferred embodiments of the present invention, but the present invention is not limited to these preferred embodiments, and it is understood that variations and modifications may be effected without departing from the spirit and scope of the present invention.

In the above-described preferred embodiments, the central control unit 46 preferably is configured and programmed to set, of the first rotational speed N1 and the second rotational speed N2, the first rotational speed N1 as the reference rotational speed Nr, but the present invention is not limited thereto. For example, the central control unit 46 may be configured and programmed to set the second rotational speed N2 as the reference rotational speed Nr, set the larger of the first rotational speed N1 and the second rotational speed N2 as the reference rotational speed Nr, or set the average value of the first rotational speed N1 and the second rotational speed N2 as the reference rotational speed Nr.

In the above-described preferred embodiments, the watercraft 1 preferably includes the first and second propulsion machines 20, 30, but the watercraft 1 may include three or more of the propulsion machines. In such a case, the central control unit 46 may be configured and programmed to set the highest engine rotational speed of the engine rotational speeds of the three or more propulsion machines as the reference rotational speed Nr or set the average value of the engine rotational speeds of the three or more propulsion machines as the reference rotational speed Nr.

In the above-described preferred embodiments, the central control unit 46 is preferably disposed independently of other apparatuses, but the central control unit 46 may be installed in another apparatus.

Although not particularly mentioned in the above-described preferred embodiments, if the central control unit 46 does not receive a control mode switching instruction because the mode switching prohibition period is in progress, the central control unit 46 may be configured and programmed to notify the operator to that effect. Examples of ways to notify the operator include, for example, turning on a lamp of the control mode switching unit 43, sounding a warning alarm, and the like.

In the above-described preferred embodiments, if the throttle valve 22*a* has moved from the open position to the fully closed position due to the movement of the first throttle lever La from the reverse propulsion range to the neutral range, the central control unit 46 preferably receives the control mode switching instruction. However, in this case, too, the mode switching prohibition period may be set to the same period as in the case wherein the throttle valve 22*a* has moved from the forward propulsion range to the neutral range.

In the above-described preferred embodiments, the central control unit 46 preferably stores the correspondence relationship described in Table 1. However, the central control unit 46 may be configured and programmed to store a calculation equation that derives the mode switching prohibition period based on the engine rotational speeds. In such a case, the central control unit 46 preferably sets the mode switching prohibition period to the value obtained by substituting the reference rotational speed Nr in the calculation equation.

In the above-described preferred embodiments, the central control unit 46 preferably is configured and programmed to determine whether or not to set the mode switching prohibition period based on the position of the throttle valve. However, the central control unit 46 may be configured and programmed to determine whether or not to set the mode switching prohibition period based on the position of the throttle lever.

The preferred embodiments of the present invention provide a watercraft propulsion system configured to reduce the load applied to a plurality of propulsion machines without using a watercraft velocity detecting device, and consequently has utility in the watercraft field.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A watercraft propulsion system comprising:

a normal watercraft operating unit including throttle levers and a steering wheel, the throttle levers being configured to adjust outputs of at least two propulsion machines mounted to a hull, and the steering wheel being configured to adjust rudder turning angles of the at least two propulsion machines;

a joy stick watercraft operating unit including a joy stick configured to move the hull in at least each of front, rear, left, and right directions;

a control unit configured and programmed to control the outputs and the rudder turning angles of the at least two propulsion machines in a control mode including a normal mode in accordance with an operation of the normal watercraft operating unit and a control mode including a joy stick mode in accordance with an operation of the joy stick watercraft operating unit;

a control mode switching unit configured to output a control mode switching instruction to the control unit when the control mode switching unit has received a switching operation of the control mode; and a detection unit configured to detect rotational speeds of engines of the at least two propulsion machines; wherein when throttle valves of the engines have moved from an open position to a fully closed position in a case where the control mode is the normal mode, the control unit does not receive the control mode switching instruction output from the control mode switching unit until a control mode switching prohibition time period elapses, and the control mode switching prohibition time period is set based on the rotational speed detected by the detection unit.

2. The watercraft propulsion system according to claim 1, wherein the control unit is configured and programmed to switch the control mode from the normal mode to the joy stick mode in accordance with the control mode switching instruction output from the control mode switching unit after the control mode switching prohibition time period has elapsed.

3. The watercraft propulsion system according to claim 1, wherein the control unit is configured and programmed to store a plurality of candidate time periods corresponding to a plurality of rotational speed ranges; and the control unit is configured and programmed to select a rotational speed range from among the plurality of rotational speed ranges and to set the control mode switching prohibition time period to a candidate time period of the rotational speed range which is selected from among the plurality of candidate time periods.

4. The watercraft propulsion system according to claim 1, wherein the control unit is configured and programmed to store a calculation equation that derives the control mode switching prohibition time period based on the rotational speeds of the engines; and the control unit is configured and programmed to set a value obtained by substituting the rotational speed in the calculation equation as the control mode switching prohibition time period.

5. The watercraft propulsion system according to claim 1, wherein the control mode switching prohibition time period is increased according to an increase in the rotational speed detected by the detection unit.

6. The watercraft propulsion system according to claim 1, wherein the throttle levers are configured to move to a forward propulsion position, a neutral position, and a reverse propulsion position; and if the throttle valves have moved from the open position to the fully closed position in accordance with an operation of the throttle levers from the reverse propulsion position to the neutral position, the control unit is configured and programmed not to set the control mode switching prohibition time period.

7. The watercraft propulsion system according to claim 1, wherein if at least one of the throttle levers have been operated during the control mode switching prohibition time period, the control unit is configured and programmed to discard the set control mode switching prohibition time period.

8. The watercraft propulsion system according to claim 1, wherein the at least two propulsion machines include a first propulsion machine and a second propulsion machine, the first propulsion machine is disposed leftward of a centerline that extends in forward and reverse directions of the hull, and the second propulsion machine is disposed rightward of the centerline; and if the control mode is the joy stick mode, then the control unit is configured and programmed to steer each of the first propulsion machine and the second propulsion machine in a toe-in direction.

9. A watercraft propulsion system comprising:

a normal watercraft operating unit including throttle levers and a steering wheel, the throttle levers being configured to adjust outputs of at least two propulsion machines mounted to a hull, and the steering wheel being configured to adjust rudder turning angles of the at least two propulsion machines;

a joy stick watercraft operating unit including a joy stick, the joy stick configured to move the hull in at least each of front, rear, left, and right directions;

a control unit configured and programmed to control the outputs and the rudder turning angles of the at least two propulsion machines in a control mode including a normal mode in accordance with an operation of the normal watercraft operating unit and a control mode including a joy stick mode in accordance with an operation of the joy stick watercraft operating unit;

a control mode switching unit configured to output a control mode switching instruction to the control unit when the control mode switching unit has received a switching operation of the control mode; and a detection unit configured to detect rotational speeds of engines of the at least two propulsion machines; wherein when the throttle levers have moved from a forward propulsion position or a reverse propulsion position to a neutral position in a case where the control mode is the normal mode, the control unit does not receive the control mode switching instruction output from the control mode switching unit until a control mode switching prohibition time period elapses, and the control mode switching prohibition time period is set based on the rotational speed detected by the detection unit.

10. The watercraft propulsion system according to claim 9, wherein the control unit is configured and programmed to switch the control mode from the normal mode to the joy stick mode in accordance with the control mode switching instruction output from the control mode switching unit after the control mode switching prohibition time period has elapsed.

11. The watercraft propulsion system according to claim 9, wherein the control unit is configured and programmed to store a plurality of candidate time periods corresponding to a plurality of rotational speed ranges; and the control unit is configured and programmed to select a rotational speed range from among the plurality of rotational speed ranges and to set the control mode switching prohibition time period to a candidate time period of the rotational speed range which is selected from among the plurality of candidate time periods.

12. The watercraft propulsion system according to claim 9, wherein the control unit is configured and programmed to store a calculation equation that derives the control mode switching prohibition time period based on the rotational speed of the engines; and the control unit is configured and programmed to set a value obtained by substituting the rotational speed in the calculation equation as the control mode switching prohibition time period.

13. The watercraft propulsion system according to claim 9, wherein the control mode switching prohibition time period is increased according to an increase in the rotational speed detected by the detection unit.

14. The watercraft propulsion system according to claim 9, wherein if the throttle levers have moved from the reverse propulsion position to the neutral position, the control unit is configured and programmed not to set the control mode switching prohibition time period.

15. The watercraft propulsion system according to claim 9, wherein if at least one of the throttle levers have been operated during the control mode switching prohibition time period, the control unit is configured and programmed to discard the set control mode switching prohibition time period.

16. The watercraft propulsion system according to claim 9, wherein the at least two propulsion machines include a first propulsion machine and a second propulsion machine, the first propulsion machine is disposed leftward of a centerline that extends in forward and reverse directions of the hull, and the second propulsion machine is disposed rightward of the centerline; and if the control mode is the joy stick mode, then the control unit is configured and programmed to steer each of the first propulsion machine and the second propulsion machine in a toe-in direction.

* * * * *